United States Patent [19]

Jenkins, Jr. et al.

[11] 4,323,084

[45] Apr. 6, 1982

[54] METHOD AND APPARATUS FOR TOBACCO LEAF DESTEMMING

[75] Inventors: Carl B. Jenkins, Jr.; Harry S. Porenski, Jr., both of Louisville, Ky.; Paul N. Turner, Kettering, Ohio

[73] Assignee: Brown & Williamson Tobacco Corporation, Louisville, Ky.

[21] Appl. No.: 207,314

[22] Filed: Nov. 17, 1980

Related U.S. Application Data

[62] Division of Ser. No. 899,768, Apr. 24, 1978, Pat. No. 4,237,909.

[51] Int. Cl.[3] ..... A24B 5/06

[52] U.S. Cl. ..... 131/319

[58] Field of Search ..... 131/329; 270/58; 493/420

[56] References Cited

U.S. PATENT DOCUMENTS 2,639,772 5/1953 Sandberg et al. ..... 493/420

4,026,000 5/1977 Anderson ..... 493/420

*Primary Examiner*—V. Millin

*Attorney, Agent, or Firm*—Charles G. Lamb

[57] ABSTRACT

The disclosure is of a method and apparatus for stripping leaf lamina from tobacco leaf stems. The apparatus comprises two pairs of opposed rollers in tandem relationship. The first set of rollers is driven at a fixed speed and serves to engage and feed tobacco leaf to the second set of rollers which are driven at a relatively higher speed. When the second pair of rollers engages the stem of the tobacco leaf, the stem is yanked away from the leaf lamina, which is held back by its engagement with the first pair of feed rollers. In this way stripping of the leaf lamina occurs. The disclosure is also of a method of destemming tobacco leaf, employing the apparatus of the invention. The method simulates the desirable results of hand stripping without an expenditure of hand stripping labor. The method is also advantageous in that it permits one to destem tobacco leaves having relatively low moisture content and at ambient temperatures, thereby effecting a considerable savings in energy expenditure.

13 Claims, 6 Drawing Figures

METHOD AND APPARATUS FOR TOBACCO LEAF DESTEMMING

This is a division of application Ser. No. 899,768, filed Apr. 24, 1978 now U.S. Pat. No. 4,237,909.

BACKGROUND OF THE INVENTION

1. Field of the Invention

The invention relates to destemming of tobacco leaf and, more particularly, relates to apparatus and processes for the separation of tobacco leaf lamina from tobacco leaf stem.

2. Brief Description of the Prior Art

Hand stripping of leaf lamina from stems gives an ideal product, i.e., two very large strips of leaf lamina and a perfectly clean stem. Unfortunately, however, hand labor is impractical from a cost standpoint for a commercial destemming process.

Conventional leaf threshing, as currently practiced commercially, comprises various methods and apparatus for beating the tobacco leaf in order to effect a separation of stems from leaf lamina in large quantities; see, for example, U.S. Pat. No. 2,941,667. Unfortunately, conventional threshing, as currently practiced commercially, devalues some usable leaf strip by converting it to dust and very small particles. Further, as stated in U.S. Pat. No. 2,941,667, "For a thresher to strip lamina from the stem in the most efficient manner, the moisture content and temperature of the tobacco must be controlled to an ideal degree." In fact, the commercially employed method of separating tobacco leaf lamina from the leaf stem comprises taking the whole leaf from storage conditions (where it generally has a moisture content of from 8 to 13 percent) and conditioning the leaf with steam and water spray to bring the moisture content up to about 21 percent at 120°–160° F. The humidified leaf is then threshed and the threshings separated a number of times (at least three separate threshings and separations). The finally separated lamina and stem remnants are then dried, screened and air separated. The stem remnants are sized and dried further to be used for reconstituted sheets, etc., and the lamina remnants are sized and dried to a moisture content of 11–15 percent for future use in smoking products.

By the method of our invention, the leaf lamina is mechanically separated from the tobacco leaf stem without the need for preconditioning the leaves to obtain high moisture contents, nor is it necessary to carry out the separation at elevated temperatures. For this reason, the method of our invention is energy saving, as well as more efficient, in that fewer procedural steps are required than in the commercially practiced threshing procedures. Further, the lamina product of the process of our invention approaches a quality hitherto only available by hand stripping of the leaf lamina.

Prior to the present invention, apparatus, including so-called "stripping roller," were employed to destem tobacco leaf; see, for example, U.S. Pat. Nos. 591,436 (1897) and 661,199 (1900). The apparatus described by these early patents are operated, essentially, by first placing the tobacco leaves in a partitioned conveyor belt. This first step is basically a hand operation and limits the effectiveness of the overall process. A mechanical stop holds the emplaced leaves on the moving conveyor belt until the previously fed leaves are delaminated. From the conveyor belt, the butts of the leaves are first drawn from the conveyor by engagement in the nip of a first set of feed rollers, which are rotating to move materials in the desired direction of leaf travel. The drawn leaves pass through an open, second set of rotating stripping rollers until the butt of the leaf reaches a third set of drawing rollers. Up until this point, the stripping rollers have been rotating to carry the leaf in the desired direction of the leaf travel. Once the butt is engaged with the drawing rollers, the stripping rollers close on the leaves passing therethrough and reverse their direction. Simultaneously, the driving rollers pull the stem away from the severed leaf lamina which then falls free. The stem is passed to additional rollers pairs which engage the stem and assure its movement away from the apparatus and residual lamina.

In U.S. Pat. No. 1,842,868 (1932) another apparatus for tobacco leaf destemming is described. Whole tobacco leaves are again hand fed, butt first, on a conveying table. It is necessary that the stems be placed at right angles to the movement of the conveyor. As the leaves progress forward, a series of card cloth felts and/or overhead metal guides holds the leaves down on the conveyor. In one version, a preliminary butting operation must take place. A rotating wire brush strips some of the lamina from the butt end of the held down leaf. The leaf, now with a clean butt, passes on to a narrow card cloth conveyor. Here the lamina is stripped back by a wire brush while the stem is pulled away from the strip by a pair of facing conveyors. These conveyors are mounted at right angles to the flow of tobacco on the side of the stripper. In still another version, the butting operation is done away with. The facing (card cloth) conveyors are slightly less than at a right angle to the directional flow, allowing for a more gradual entrance of the stem into the take-away conveyors.

Those skilled in the art will appreciate that the prior known tobacco leaf destemming apparatus are not completely satisfactory for a number of reasons. For example, as described above, their operation still requires a great deal of hand labor. Further, the prior art apparatus is rather complicated, subject to breakdown, and limited in through-put rates. In addition, the use of card cloth and wire brushes damages the tobacco leaf lamina.

The apparatus of the present invention is an improvement in the art in that it provides for higher throughputs and will accommodate overlapped, padded leaves, regardless of the position of one leaf to another. It is also not necessary to butt feed tobacco leaves to the apparatus of the present invention, good results being obtained even with tip feeding. For that matter, anything other than an exact sideways orientation of the tobacco leaf gives good stripping results in the apparatus of the present invention. This eliminates hand labor for orienting the leaves. Further, the apparatus of the present invention is fully continuous and mechanically quite simple and foolproof in operation. Since the apparatus of the present invention employs elastomeric rollers, there is minimal tearing of the tobacco leaf and minimum clogging of the apparatus with small pieces.

In summary, the apparatus and process of the present invention approach the results obtained by hand stripping, but without the time and labor consumption required in hand stripping. For example, by using the apparatus of the invention it is possible to remove up to 96 percent of tobacco leaf lamina in a single pass of a given leaf through the apparatus of the invention. Sixty percent of the lamina so removed is of a size retainable on a 1-inch screen. The stripped stem remains intact in almost all instances and is easily separated undamaged.

A further advantage of the apparatus of the present invention resides in the fact that its higher speed of conveying and stripping will shake off undesirable sand and foreign materials, reducing the need for later separations of these undesired contaminants.

The advantage of the method and apparatus of our invention is a reduction in tobacco loss and a finer quality tobacco product after destemming.

SUMMARY OF THE INVENTION

The invention comprises apparatus for destemming tobacco leaves, which comprises;

a first pair of rotatable rollers, each of said rollers of said first pair being disposed in a face-to-face relationship with the other of said rollers so that a nip is formed between said rollers;

a second pair of rotatable rollers, each of said rollers of said second pair being disposed in a face-to-face relationship with the other of said rollers so that a nip is formed between said second pair of rollers;

said rollers being faced with an elastomeric, gripping material;

means of adjusting the nip between the rollers of each pair of rotatable rollers;

means for mounting the first pair of rollers in tandem relationship with said second pair of rollers, whereby the nip of said first pair of rollers is in axial alignment with the nip of said second pair of rollers;

means for rotating one of each pair of rollers in a clockwise direction and the other of each pair of rollers in a counter-clockwise direction, said directions being such that a leaf introduced into the nip of said first pair of rollers will be carried to the nip of said second pair of rollers and upon entry into the nip of said second pair of rollers from said first pair of rollers will be carried away from said first pair of rollers; and means for controlling the speed of rotation of said rollers so that the speed of said second pair of rollers is faster than the speed of said first pair of rollers.

The invention also comprises a continuous process for destemming tobacco leaves, which comprises;

(a) providing destemming apparatus which comprises;

a first pair of rotatable rollers, each of said rollers of said first pair being disposed in a face-to-face relationship with the other of said rollers so that a nip is formed between said rollers;

a second pair of rotatable rollers, each of said rollers of said second pair being disposed in a face-to-face relationship with the other of said rollers so that a nip is formed between said second pair of rollers;

said rollers being faced with an elastomeric, gripping material;

means of adjusting the nip between the rollers of each pair of rotatable rollers;

means for mounting the first pair of rollers in tandem relationship with said second pair of rollers whereby the nip of said first pair is in axial alignment with the nip of said second pair of rollers;

means for rotating one of each pair of rollers in a clockwise direction and the other of each pair of rollers in a counter-clockwise direction, said directions being such that a leaf introduced into the nip of said first pair of rollers will be carried to the nip of said second pair of rollers and upon entry in the nip of said second pair of rollers from said first pair will be carried away from said first pair of rollers; and means for controlling the speed of rotation of said rollers so that the speed of said second pair of rollers is faster than the speed of said first pair of rollers;

(b) providing tobacco leaves;

(c) causing the rollers of said apparatus to rotate as described above;

(d) feeding said tobacco leaves to the nip of said first pair of rollers whereby they are engaged by said first pair and the stem is yanked by said second pair of rollers causing a stripping of the leaf lamina from the stem of the tobacco leaves; and (e) sorting the separated lamina from the stems of the tobacco leaves.

DETAILED DESCRIPTION OF THE PREFERRED EMBODIMENTS OF THE INVENTION

Figure 1:
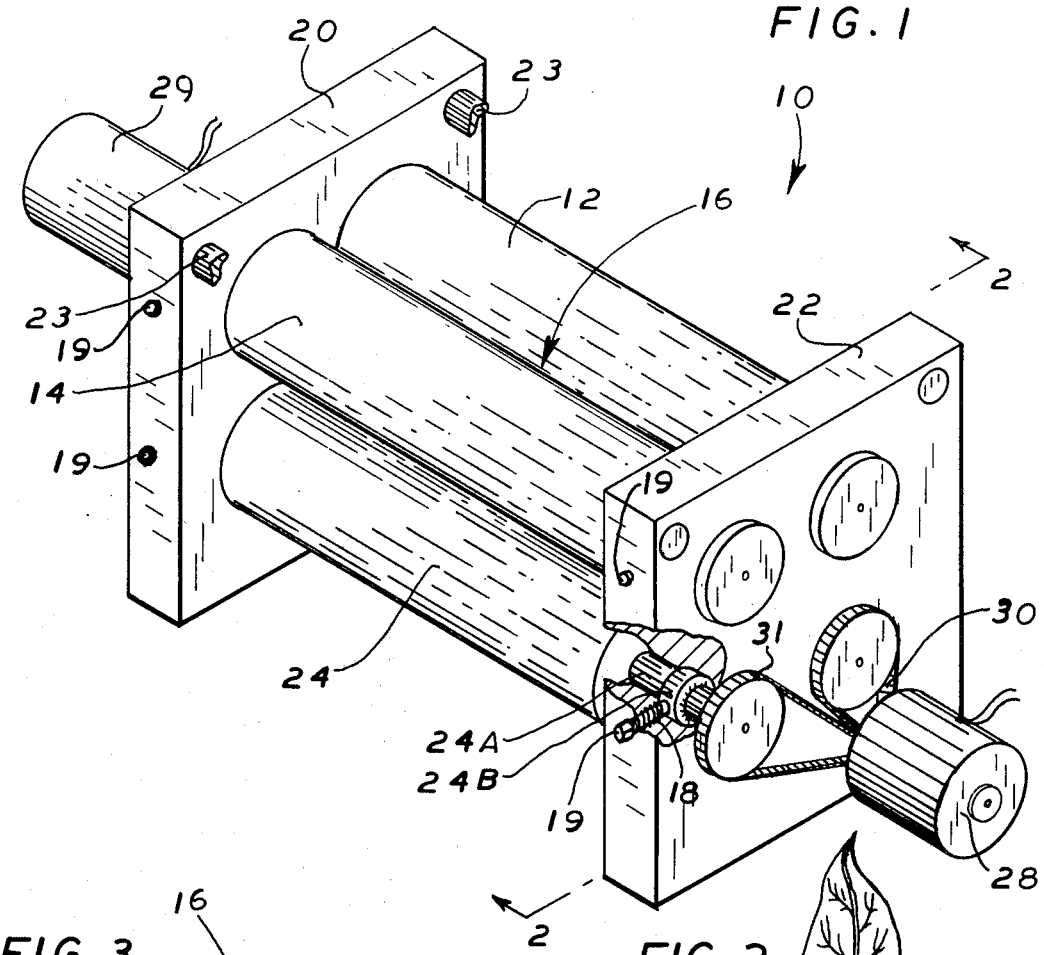
FIG. 1 is a view, in perspective, of a preferred embodiment of an apparatus of the present invention.

Referring first to FIG. 1, there is shown a preferred embodiment of the apparatus 10 of the present invention. Apparatus 10 comprises a first pair of rotatable rollers 12 and 14. Rollers 12 and 14 are disposed in face-to-face relationship with each other so that a nip 16 is formed between the rollers 12 and 14. The rollers 12 and 14 are generally fabricated from an elastomeric material but may be fabricated from any conventionally employed roller material and faced with an elastomeric, gripping material. For example, as shown in FIG. 6, a view taken along lines 6—6 of FIG. 5, which is a view of a roller 24, we have found that a $\frac{3}{4}$ inch metal shaft 25 built up to $2\frac{1}{4}$ inches with an elastomeric face 27 is one preferred roller. Representative of elastomeric, gripping materials are polyurethane non-cellular elastomers, natural rubber, synthetic butyl rubber and like materials. Preferred are natural elastomers, such as natural rubber. Preferably, the elastomeric face of the rollers 12, 14 will have a durometer hardness of from between 30 to 50 Shore A. The rollers 12, 14 may, if desired, bear a tread design surface to grip the tobacco leaf lamina. For example, the roller face of rollers 12, 14 may have a corrugated surface of open square design as a form of a discontinuous, frictional surface (as opposed to a continuous, noncorrugated, frictional surface).

Figure 2:
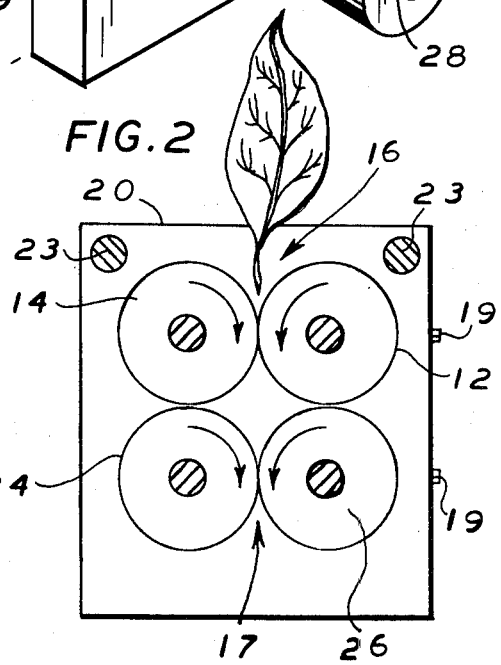
FIG. 2 is a cross-sectional side elevation of the apparatus shown in FIG. 1, taken along line 2—2, showing a tobacco leaf about to be introduced therein.

The rollers 12, 14 are mounted on roller supports 20 and 22 as a support means, in tandem relationship with a second pair of rotatable rollers 24, 26 (roller 26 not seen in FIG. 1). Supports 20, 22 are held together by the tie-bars 23 (shown fragmented in FIG. 1). The second pair of rotatable rollers 24, 26 are also disposed in a face-to-face relationship with each other so that a nip 17 (not seen in FIG. 1) is formed between said second pair of rollers. Rollers 24, 26 are also faced with an elastomeric material or they may be fabricated entirely from an elastomeric material. In fact they may be identical in construction to rollers 12, 14 but preferably have a harder elastomeric surface (40 to 70 Shore A hardness). The nip 16 of rollers 12, 14 is in axial alignment with the nip 17 between rollers 24, 26 as best seen in FIG. 2, a cross-section taken along lines 2—2 of FIG. 1. The rollers 12, 14, 24 and 26 are preferably individually driven rollers so that their speeds may be controlled independently. However, they may, also, be made up of one or more driven rollers and the remainder as carrier rollers with proper gear arrangements.

Individually driven roller pairs 12, 14 and 24, 26 are advantageous in that they provide for a smooth tobacco leaf feed and increase the stripping action as will be described in greater detail hereinafter. The speed of individually driven roller pairs may, also, be more critically adjustable to control throughput. In the preferred embodiment of FIG. 1, the rollers 12, 14 are driven at a speed of about one-third that speed assigned to rollers 24, 26 by variable speed electric motor 29 while rollers 24, 26 are driven at the higher speed by variable speed electric motor 28 through a conventional gear train (not seen in FIG. 1) which transmits power to the rollers 24, 26 through individual power belts 30 and 31. The power train for rollers 12, 4 may be similar to that for rollers 24, 26.

Usually, the first pair of rollers 12, 14 are positioned as close as possible to the second pair of rollers 24, 26 so short butt stem tobacco leaves are engaged by rollers 24, 26 before any significant leaf lamina passes completely through nip 16. Generally, not more than a 3-inch space between roller sets is advantageous. The spacing between roller pairs 12, 14 and 24, 26 also has a bearing upon control of the particle sizes obtained during destemming as discussed hereinafter.

As optional and advantageous features, the apparatus 10 of the invention may include nip adjustable, spring loaded floating rollers 12, 14, 24, 26 to allow occasional pads of leaves to pass through and yet maintain control of the tension on the tobacco leaf. In FIG. 1, it may be seen that adjustable springs 18 are provided to tension rollers 24, 26 against one another to adjust the nip 17. Adjustment of the spring tension is made by screw 19 which may be inserted to increase tension and withdrawn to decrease tension on roller 24. The rollers 12, 14 are similarly adjusted.

Figure 5:
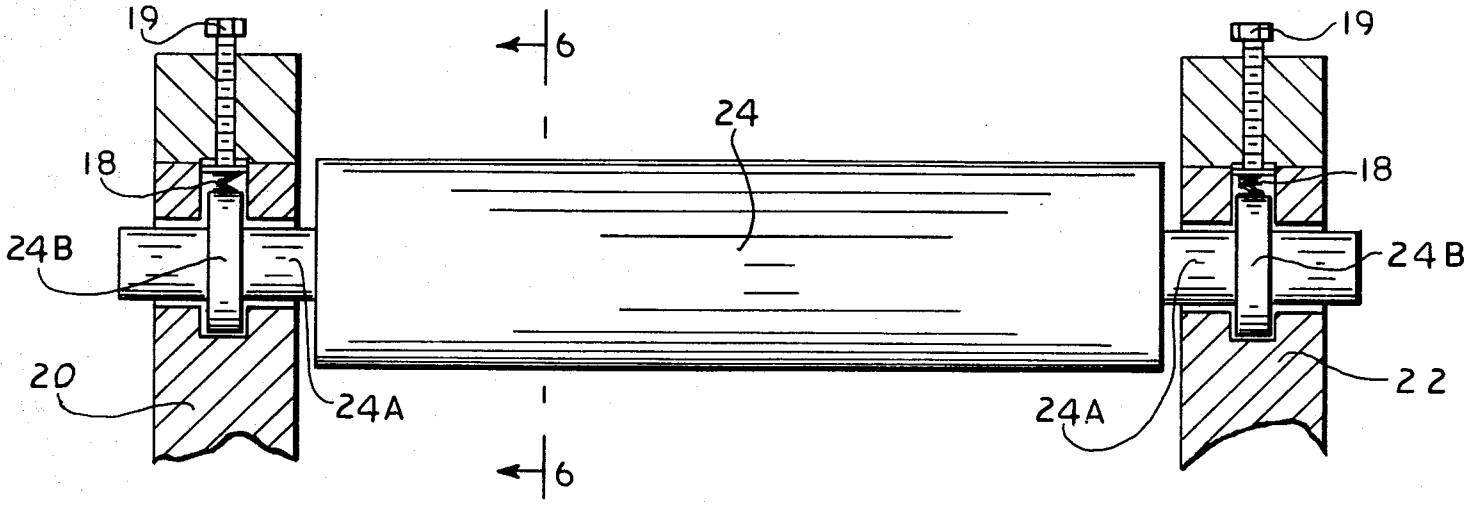
FIG. 5 is an exploded view of one of the roller components of the apparatus shown in FIG. 1.
Figure 6:
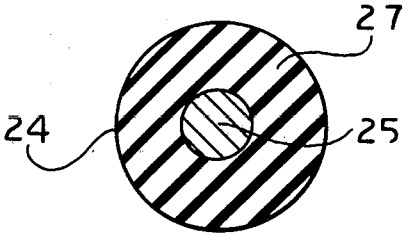
FIG. 6 is a view, taken along lines 6—6 of FIG. 5.

Referring now to FIG. 5, one can see greater detail of the spring loaded adjusting feature, FIG. 5 being an exploded view of the roller 24 mounted in roller supports 20 and 22. Roller 24 and its mounting is representative of the mounting of rollers 12, 14 and 26, it being realized that one of the rollers in each pair of rollers 12, 14 and 24, 26 need not be connected to driving means, if so desired. The roller 24 is floatably mounted in supports 20, 22 by axle 24 A which is supported on bearing 24 B. Opposite springs 18 on each bearing 24 B are adjusting screws 19 which are tensioned by springs 18 against the bearings 24 B. By adjustment of the screws 19 in or out, one can move roller 24 out or in to open and close the nip 17 between rollers 24, 26 and to tension the roller 24 against the roller 26. The degree of tension will determine the gripping force exerted on leaf components. A similar arrangement exerts a gripping force between roller 12 and 14.

Figure 3:
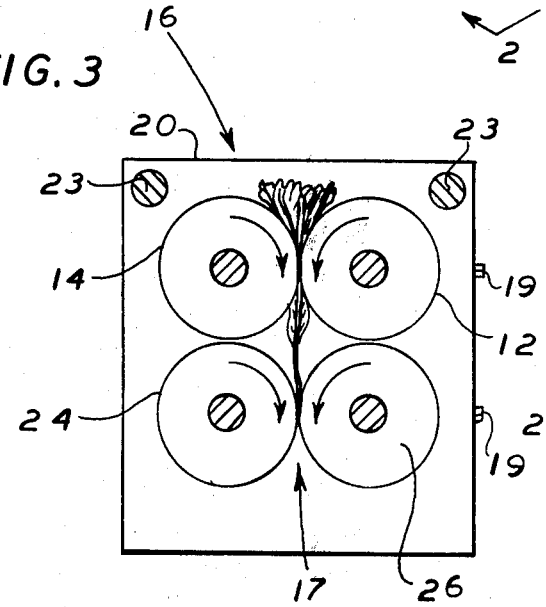
FIG. 3 is a view as shown in FIG. 2, but with the tobacco leaf delaminated.

In operation, one of each of rollers 12 or 14 and 24 or 26 in the pairs will rotate in the clockwise direction while the other roller of each pair rotates in a counter-clockwise direction so that when tobacco leaves are fed into the nip 16 between rollers 12, 14 (see FIG. 2), the leaves will be drawn therein and passed to the nip 17 of the second pair of rollers 24, 26. Upon entering the nip 17 between rollers 24, 26, which travels at a higher rate of speed than rollers 12,14, the tobacco leaf stem will be yanked through the nips 16, 17. In doing so, the slower moving pair of rollers 12, 14 will grip the tobacco leaf lamina according to the degree of tension exerted thereon by the tensioned roller and hold it while the stem portion of the leaf is yanked free, as shown being initiated in FIG. 3. FIG. 3 is a view of the apparatus 10 as seen in FIG. 2. Following the severance of the tobacco leaf lamina from the stem, both stem and lamina proceed through the nips 16, 17 of the two pairs of roller 12, 14 and 24, 26 to fall free beneath the apparatus 10. The rollers may be operated at any desired speed, 120 rpm for rollers 12, 14 and 360 rpm for rollers 24, 26 appearing to be one preferred representative speed for destemming.

The method of the invention is carried out by first providing the apparatus of the invention which preselected tobacco leaves generally having a moisture content of from 10 to 18 percent by weight. Preferably, the leaves will have a moisture content of from about 10 to about 14 percent by weight (the usual moisture content of warehoused tobacco leaves). The leaves are fed to the nip 16 of the first or holding pair of rollers 12, 14 of the apparatus 10 of the invention. The stem of the leaf is carried to the nip 17 of the second or pulling pair of rollers 24, 26. The gripping action of the roller pairs 12, 14 and 24, 26 is controlled by spring tension as previously described. The holding rollers 12, 14 must supply enough force on the leaf lamina to hold back the leaf lamina while the stem is being pulled through the rollers 24, 26. This holding force must be sufficient to allow the stem/lamina bond to break, but not great enough to cause the stem to break. We have found that optimal results are obtained when the holding or first pair of rollers 12, 14 are under a tension against each other of from 15 to B 25 lbs. The pulling or second pair of rollers 24, 26 should be set at a tension against each other of from 40 to 50 lbs. to assure proper stem gripping action. These ranges of tensions are for rollers having the aforementioned preferred hardness ranges (30 to about 50 Shore A for the holding rollers and 40 to 70 for the pulling rollers). For harder rollers, less tension is required and for softer rollers more tension is necessary. Those skilled in the art can determine optimal tensions for rollers of other hardness by trial and error technique.

The method of the invention may be carried out at any desired temperature, up to about 120° F. or greater, if desired. However, it is preferably carried out at room temperatures (about 76° F.). This is energy saving, since the tobacco leaves need not be heated, need not be moisturized beyond normal moisture limits found in stored leaves or to the level required for threshing (about 20–21 percent). Consequently, the destemmed lamina need not be dried after destemming to the degree generally required of threshed tobacco.

The separated leaf lamina stems may be sorted by weight; i.e., by airstream separation.

The following examples describe the manner and process of making and using the invention and set forth the best mode contemplated by the inventors of carrying out the invention, but is not to be construed as limiting.

EXAMPLE 1

A tobacco leaf destemmer was constructed according to the above description of the embodiment of FIG. 1, employing two sets of natural rubber faced rollers, each 2 inches in diameter and 11 inches long, spaced 3 inches apart. The 3-inch space between the rollers allows only 1 inch of open space between the two pairs of rollers. The first pair of rollers was wrapped in soft rubber laboratory mats having a durometer hardness of Shore A 30. These mats had an open $\frac{5}{8}$-inch square design. The second pair of rollers had a durometer hardness of Shore A 60. The rollers were driven by a variable speed $\frac{1}{2}$ horsepower motor connected by a drive belt to each of the pairs of rollers. The first pair of rollers was driven at a speed of about 120 rpm and the second pair of rollers was driven at a speed of approximately 360 rpm. Burley leaf tobacco, having a moisture content of about 11.7 percent, from the 1974–1975 crop was provided. A portion of these leaves was fed to the destemmer apparatus, butt first, in a single pass and the remaining portion was fed to the apparatus, tip first, in a single pass. The destemming efficiency of the process was determined by hand stripping the remaining leaf from the stem and calculating the percent (by weight) of available lamina remaining on the stem. Leaf break-up was determined by measuring the particle size of the destemmed lamina on the Canadian shaker. The results of destemming are shown in Table 1 below.

TABLE 1

ENTRANCE ROLLERS RUBBER LAB MATT WRAPPED (SHORE A = 30)

| | Butt First-Single Pass | | Tip First-Single Pass | |
|---|---|---|---|---|
| Size in. | Wt. gms | % Avail. Lamina | Wt. gms | % Avail. Lamina |
| +1 | 66.3 | 61.1 | 62.5 | 66.1 |
| $+\frac{1}{2}$, −1 | 28.7 | 26.4 | 18.4 | 19.5 |
| $+\frac{1}{4}$, $-\frac{1}{2}$ | 6.4 | 5.9 | 6.8 | 7.2 |
| $+\frac{1}{8}$, $-\frac{1}{4}$ | 1.6 | 1.5 | 1.6 | 1.7 |
| $-\frac{1}{8}$ | 2.1 | 1.8 | 1.6 | 1.7 |
| Totals | | 96.7% | | 96.2% |
| Stem Fraction: | | | | |
| Stem | 52.6 g (32.6% sample wt.) | | 42.1 g (30.8% sample wt.) | |
| Unseparated lamina | 3.6 g (3.3% lamina wt.) | | 3.7 g (3.9% lamina wt.) | |

As shown in Table 1, about 96 percent of the available leaf lamina was removed in the first pass. The particle size of the two samples was essentially the same. Sixty-one to sixty-six percent of the leaf lamina was retained on a 1-inch screen and less than 2 percent of the material passed a $\frac{1}{8}$-inch screen. The stem fraction accounts for about 34 percent of the sample. The stem fractions contain less than 4 percent of the leaf lamina as attached material. On a second pass through the apparatus, the yield of lamina is increased to about 98 percent, with a minimum of 60 percent of the lamina obtained in the second pass having a particle size greater than 1 inch.

EXAMPLE 2

The destemmer unit of Example 1 was modified by replacing the first pair of rollers with natural rubber-faced (continuous surface) rollers with a Shore A hardness of 30. Ten samples of flue-cured tobacco leaves, between 1 and 2 lbs. each, were conditioned to about 15 percent moisture. Half of these samples were run through the modified destemmer apparatus butt first and the remaining half tip first. The unit was adjusted so the holding rollers turned at 200 rpm and were under 25 lbs. of tension. The pulling rollers were under 50 lbs. of tension and turned at about 560 rpm. The results are given in Table 2 below.

TABLE 2

| Orientation | Tip | | | | | Butt | | | | |
|---|---|---|---|---|---|---|---|---|---|---|
| % Moisture | 14.3 | 14.4 | 14.6 | 14.7 | 14.9 | 14.8 | 15.3 | 15.8 | 15.9 | 16.7 |
| % Unseparated Lamina | 12.4 | 27.1 | 10.7 | 12.0 | 23.1 | 10.3 | 33.8 | 35.8 | 26.1 | 13.5 |
| Size | Percent Lamina | | | | | | | | | |
| +1" | 68.3 | 47.8 | 69.6 | 65.9 | 51.1 | 70.6 | 45.1 | 41.0 | 46.2 | 69.7 |
| $+\frac{1}{2}$", −1" | 10.4 | 15.8 | 12.5 | 12.9 | 15.1 | 11.2 | 14.4 | 14.4 | 19.0 | 9.9 |
| $+\frac{1}{4}$", $-\frac{1}{2}$" | 4.7 | 5.4 | 4.0 | 4.6 | 5.9 | 4.8 | 4.8 | 5.1 | 5.8 | 4.0 |
| $+\frac{1}{8}$", $-\frac{1}{4}$" | 2.1 | 2.0 | 1.3 | 2.3 | 1.8 | 1.6 | 1.0 | 1.9 | 1.9 | 1.0 |
| $-\frac{1}{8}$" | 2.1 | 2.0 | 1.8 | 2.3 | 2.3 | 1.6 | 1.0 | 1.9 | 1.0 | 2.0 |
| Total Lamina Removed | 87.6 | 73.0 | 89.2 | 88.0 | 76.2 | 89.8 | 66.3 | 64.3 | 73.9 | 86.6 |

It may be seen from Table 2 that samples fed to the destemmer butt first produced significantly more +1 inch particle size material and have significantly less leaf lamina remaining attached to the stem than occurred in the tip fed samples. Butt fed samples removed 68.7 percent of the lamina as +1 inch material while tip fed samples removed only 46.2 percent of the lamina as +1 inch material. Tip fed samples left 29.2 percent of the leaf remaining attached to the stem after a single pass while butt fed samples left only 11.8 percent of the lamina attached.

EXAMPLE 3

In conventional threshing, both heat and moisture are added to whole tobacco leaves to control tobacco break-up during processing. Both of these treatments supposedly achieve the same effect; therefore, we examined them together in a single experiment. The destemmer unit of Example 2 above was used with the holding rollers under 25 lbs. tension. The pulling rollers were under 50 lbs. tension. The holding rollers turned at 120 rpm and the pulling rollers at 336 rpm. Tobacco conditioning temperatures were 75° and 120° F. The tobacco was hand fed to the destemmer butt first, one leaf at a time. Experimental results are given in Table 3 below.

TABLE 3

EFFECTS OF HEAT AND MOISTURE ON DESTEMMING
Samples Destemmed Butt First

| Temperature | 75° F. | | | | | | 120° F. | | | | | |
|---|---|---|---|---|---|---|---|---|---|---|---|---|
| Moisture | Low | | | High | | | Low | | | High | | |
| % Moisture | 12.8 | 13.5 | 13.5 | 16.4 | 17.2 | 18.7 | 13.6 | 14.5 | 14.8 | 16.4 | 17.1 | 17.8 |

TABLE 3-continued

EFFECTS OF HEAT AND MOISTURE ON DESTEMMING
Samples Destemmed Butt First

| % Unseparated Lamina | 7.7 | 8.7 | 8.9 | 13.2 | 11.9 | 12.4 | 9.7 | 11.9 | 16.7 | 18.2 | 31.9 | 19.5 |
|---|---|---|---|---|---|---|---|---|---|---|---|---|
| Size | Percent Lamina | | | | | | | | | | | |
| +1" | 53.3 | 61.9 | 62.4 | 71.4 | 57.6 | 69.1 | 49.8 | 61.8 | 58.6 | 50.0 | 48.0 | 55.0 |
| +½", −1" | 23.1 | 15.6 | 15.7 | 8.6 | 16.0 | 9.1 | 19.2 | 14.7 | 10.8 | 15.6 | 11.6 | 11.9 |
| +¼", −½" | 8.2 | 6.9 | 6.2 | 3.2 | 7.3 | 4.7 | 10.9 | 6.6 | 6.9 | 7.6 | 4.0 | 6.6 |
| +⅛", −¼" | 2.7 | 1.7 | 2.2 | .9 | 1.8 | 1.3 | 4.9 | 2.0 | 3.0 | 3.0 | 1.0 | 2.2 |
| −⅛" | 4.9 | 5.2 | 4.5 | 2.7 | 5.3 | 3.5 | 5.5 | 3.0 | 3.9 | 5.6 | 3.5 | 4.8 |
| Total lamina removed | 92.2 | 91.3 | 91.0 | 86.8 | 88.0 | 87.7 | 90.3 | 88.1 | 83.2 | 81.1 | 68.1 | 80.5 |

As reported in Table 3 above, leaves destemmed at room temperature had significantly more +1-inch material than samples destemmed at 120° F. On the average, room temperature destemmed samples yielded 62.6 percent of +1-inch lamina, while samples destemmed at 120° gave only 53.9 percent of +1-inch lamina. No change was noted in the +1-inch fraction between the samples.

The lower moisture content samples left significantly less leaf remaining on the stem than the higher moisture content samples. The drier samples averaged 10.6 percent attached lamina, while the wetter samples averaged 17.9 percent attached lamina. Room temperature destemming also left significantly less lamina attached to stem than destemming at higher temperatures. The amounts of lamina remaining attached to stem after room temperature destemming was 10.5 percent and 18 percent for the higher temperature destemming.

Summarizing, best results were achieved with leaves destemmed at 75° F. and having 13.8 percent moisture content.

Those skilled in the art will appreciate that the destemming apparatus 10 may be employed as part of a continuous process for the destemming and separation of tobacco leaf stems from tobacco leaf lamina.

Figure 4:
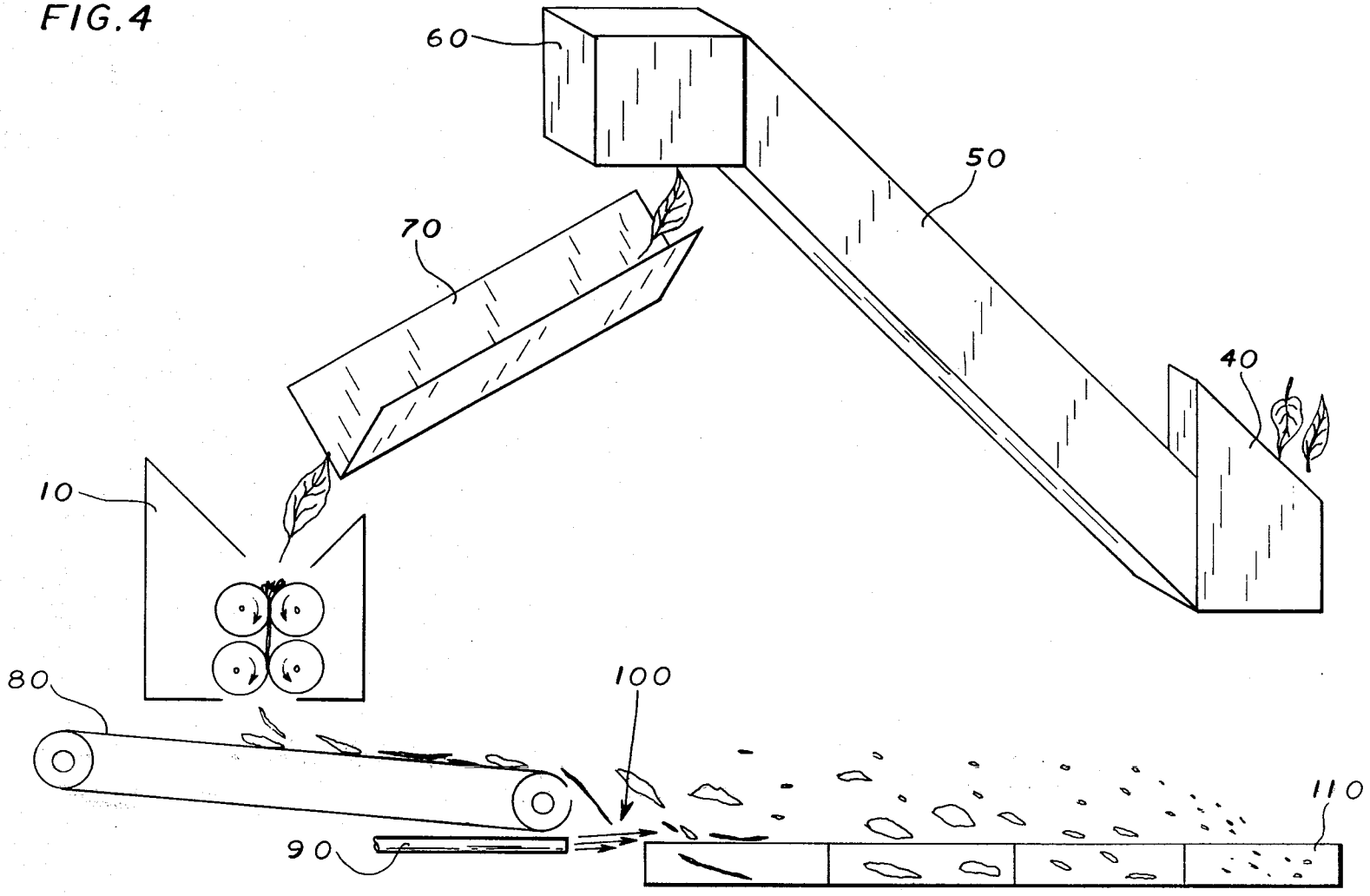
FIG. 4 is a flow diagram showing a preferred embodiment of a continuous process of the present invention for the destemming of tobacco leaves, the flow diagram employing the embodiment apparatus of FIG. 1.

Referring now to FIG. 4, a process flow sheet for an embodiment of the continuous process of the invention, one can see a tobacco feed bin 40 which feeds tobacco leaf on tobacco metering conveyor 50 to a tobacco air drop 60. From tobacco air drop 60 the tobacco leaves fall onto a V-shaped trough or tobacco leaf aligner 70 to align and orient the tobacco leaves so that either the butt end or tip end of the leaf is fed directly to the leaf destemmer 10. Upon destemming, the stems and separated lamina fall on to a conveyor belt 80 and are carried to air separator zone 90 where the stems and lamina are sorted according to their weight by the air flow 100, falling into segregated collectors 110 according to their weight. In this manner, the apparatus of the invention may be utilized to its full potential in a commercially feasible continuous process according to the method of the invention.

What is claimed is:

1. A continuous process for destemming tobacco leaves, which comprises:

(a) providing destemming apparatus which comprises;

a first pair of rotatable rollers, each of said rollers being disposed in a face-to-face relationship with the other of said rollers so that a nip is formed between said rollers;

a second pair of rotatable rollers, each of said rollers of said second pair being disposed in a face-to-face relationship with the other of said rollers so that a nip is formed between said second pair of rollers;

said rollers being faced with an elastomeric, gripping material;

means of adjusting the nip between the rollers of each pair of rotatable rollers;

means for mounting the first pair of rollers in tandem relationship with said second pair of rollers whereby the nip of said first pair of rollers is in axial alignment with the nip of said second pair of rollers;

means for rotating one roller of each pair in a clockwise direction and the other roller of each pair in a counterclockwise direction, said directions being such that a leaf introduced into the nip of said first pair of rollers will be carried to the nip of said second pair of rollers and upon entry into the nip of said second pair of rollers from said first pair will be carried away from said first pair of rollers; and means for controlling the speed of rotation of said rollers so that the speed of said second pair is faster than the speed of said first pair;

(b) providing tobacco leaves;

(c) causing the rollers of said apparatus to rotate as decribed above;

(d) feeding said tobacco leaves to the nip of said first pair of rollers whereby they are engaged by said first pair and the stem is yanked by said second pair of rollers causing a stripping of the leaf lamina from the stem of the tobacco leaves; and (e) sorting the separated laminae from the stems of the tobacco leaves.

2. The process of claim 1 wherein said elastomeric, gripping material is natural rubber.

3. The process of claim 1 wherein said first pair of rollers has a face durometer hardness of from between 30 to about 50 Shore A.

4. The process of claim 3 wherein the roller surface is corrugated.

5. The process of claim 3 wherein the roller surface is continuous.

6. The process of claim 1 wherein said second pair of rollers has a face durometer hardness of from between 40 to about 70 Shore A.

7. The process of claim 1 wherein said means of adjusting the nip includes spring loaded mounting of a roller.

8. The process of claim 1 carried out at room temperatures.

9. The process of claim 1 wherein the tobacco leaves are fed butt end first.

10. The process of claim 1 wherein the tobacco leaves are fed tip end first.

11. The process of claim 3 wherein said first pair of rollers are tensioned against one another under a force of from about 15 to 25 lbs.

12. The process of claim 6 wherein said second pair of rollers are tensioned against one another under a force of from about 40 to 50 lbs.

13. The process of claim 1 wherein the sorted stems are fed in step (d) to effect further separation of laminae incompletely separated on the first feeding.

* * * * *